US006107952A

United States Patent [19]

Barker et al.

[11] Patent Number: 6,107,952

[45] Date of Patent: Aug. 22, 2000

[54] CROSSED SKIRT ANTIRADAR SCREEN STRUCTURE FOR SPACE VEHICLES

[75] Inventors: William C. Barker, Pacific Palisades; Donald M. Slager, Long Beach, both of Calif.

[73] Assignee: TRW Inc., Redondo Beach, Calif.

[21] Appl. No.: 05/103,909

[22] Filed: Jan. 4, 1971

[51] Int. Cl.[7] ..... H01Q 15/00

[52] U.S. Cl. ..... 342/13; 342/10

[58] Field of Search ..... 244/155, 15 C, 244/121; 343/18 R, 18 B, 18 E; 350/288, 292, 299, 303; 342/8, 10, 11, 1–4, 13

[56] References Cited

U.S. PATENT DOCUMENTS 2,953,377 9/1960 Brust ..... 343/18 R 3,122,743 2/1964 Vlasic ..... 343/18 R

*Primary Examiner*—Michael J. Carone

*Attorney, Agent, or Firm*—Michael S. Yatsko

[57] ABSTRACT

A crossed skirt antiradar screen structure for a space vehicle, such as an orbiting satellite vehicle, having members projecting laterally from the main vehicle body. The screen structure includes multiple primary and auxiliary radar screens having electrically conductive skirts at least partially enclosing the vehicle body and the projecting members in a manner such that the screens cooperate to control the radar cross-section and signature of the entire vehicle. According to an important feature of the invention, the several radar screens are so shaped and arranged that all interior corners defined by the screen skirts have oblique angles which preclude retroreflection of an illuminating radar beam from a ground based radar detection system.

6 Claims, 5 Drawing Sheets

CROSSED SKIRT ANTIRADAR SCREEN STRUCTURE FOR SPACE VEHICLES

RELATED APPLICATIONS

Reference is made herein to copending applications Ser. No. 04/591,395 now abandoned, filed Oct. 28, 1966 and entitled "Radar Target Simulator (U)"; Ser. No. 04/593,233, filed Nov. 4, 1966 and entitled "Inflatable Anti-Radar Screen (U)"; and Ser. No. 04/721,513, filed Apr. 8, 1968 and entitled "Radar Screen (U)".

BACKGROUND OF THE INVENTION

1. Field of the Invention

This invention relates generally to the art of controlling and suppressing the radar cross-section and signature of a space vehicle, particularly an orbiting satellite vehicle, either for the purpose of preventing its detection by ground based radar detection systems or modifying its radar signature to resemble another space vehicle, such as a decoy. The invention relates more particularly to a space vehicle antiradar screen structure having a novel crossed skirt configuration.

2. Prior Art

At the present state of development of the space vehicle detection art, the most important vehicle observable to be controlled is radar cross-section or signature. This is particularly true of orbiting satellite vehicles whose repeated passes around the earth allow ample time for radar signature analysis and possible ultimate identification of the satellite. A variety of techniques have been devised for controlling and reducing radar cross-section of a space vehicle in a manner such that the vehicle may be effectively decoyed. Such an antiradar device or antiradar screen must either completely deny detection of the space vehicle by search radar or reduce and modify the radar cross-section of the vehicle to permit employment of other aids, such as decoys, to confuse and delay final identification.

A proper signature match between target vehicle and decoys without modification in the target signature would require the external configuration of the decoys to substantially duplicate that of the target vehicle. In most cases, for example, the target vehicle has a characteristic fine structure of large magnitude in its radar signature which varies with frequency, polarization, and radar look angle. Duplication of this signature with a decoy would require a decoy of the same size and shape as the target vehicle, which is often impractical. As a consequence, the most effective method of shielding a target vehicle is that wherein the radar signature of the vehicle is modified to a simplified, reduced magnitude form and the vehicle is accompanied by a swarm of decoys having essentially the same radar signature as the screened target vehicle so as to cause confusion and delay in detection.

A decoy which may be used in conjunction with the signature modifying device of this invention is disclosed in applicant's copending patent application Ser. No. 04/591,395, filed Oct. 28, 1966 and entitled "Radar Target Simulator (U)" now abandoned.

U.S. Patent No. 3,233,238 discloses an antiradar screen structure for reducing radar reflection from a space vehicle. This screen structure has a cone-like shape which completely covers the vehicle and can reduce the radar reflection area to approximately a square centimeter, depending upon the frequency of the illuminating radar, the angle of the cone apex, and the reflections due to first or second order discontinuities of the vehicle's surface structure. To utilize this type of screen on an elongated vehicle body, would require a cone with a major diameter greater than the length of the vehicle which in turn would make the cone quite large in length and width.

Copending applications Ser. Nos. 04/593,233 and 04/721,513 disclose improved antiradar screens in the form of a plurality of overlapping (osculating) biconvex lenses. A line tangent to the edges of these lenses determines the contour of an arcuate keel edge of the screens. A search radar whose energy is striking this contoured edge in the plane which passes through the edges and centers of the lenses can detect only a cross-section of conductive material above the detection threshold of the radar. The cross-section of each of the lenses is chosen to be below such detection threshold. The screen is otherwise shaped such that incident radiation striking the screen outside of the edge plane also encounters a cross-section which is below the detection threshold of the radar. This is accomplished by maintaining the angle formed by the juncture of the surfaces of the screen, at the keel edge, below a value which is determined by the type of radar used and the vehicle distance from the radar.

An antiradar screen such as that just discussed must be stowed in the vehicle during launch and deployed to its operational configuration after orbit is achieved. Stowage and deployment of the screen may be accomplished in various ways. By way of example, the screen structure of copending application Ser. No. 04/593,233 is deployed in orbit by inflation of a tubular frame structure supporting the conductive skirts of the screen.

SUMMARY OF THE INVENTION

The present invention provides a novel deployable crossed skirt antiradar screen structure which is designed for use on a space vehicle, particularly an orbiting satellite vehicle, having members projecting laterally from the main vehicle body. These projecting members may be cross arms, solar panels, linear antennae, or other projecting devices.

The crossed skirt antiradar screen structure of the invention includes a primary radar screen enclosing the main body of the space vehicle and auxiliary radar screens enclosing the projecting members. The several radar screens have the biconvex lens configuration disclosed in copending application Ser. No. 04/721,513. The present radar screen structure may be designed to totally deny the detection of the space vehicle by ground based radar systems or merely modify the vehicle radar signature to resemble another space vehicle, such as a decoy.

In one disclosed form of the invention, the conductive skirts of the primary and auxiliary radar screens are physically and electrically joined to form, essentially, a single conductive skirt structure having a longitudinal portion enclosing the vehicle body and lateral portions enclosing the projecting members of the body. In another disclosed from of the invention, the primary and auxiliary radar screens have separate conductive skirts.

A feature common to both forms of the invention is the particular formation of interior corners by the conductive skirts of the primary and auxiliary radar screens. According to an important feature of the invention, the skirts are shaped and arranged in a manner such that these interior corners have oblique angles which prevent retroreflection of an illuminating radar beam from a ground based radar detection site back to the site. According to the preferred practice of the invention, for example, each interior corner defined by the skirts of the primary and auxiliary radar screens have an angle equal to or greater than 100°.

Stowage and deployment of the present crossed skirt antiradar screen structure may be accomplished in any convenient way. For example, the screen structure may be deployed by the phenumatic deployment technique of copending application Ser. No. 04/593,233 or by elastic strain energy.

DESCRIPTION OF THE PREFERRED EMBODIMENTS

Figure 1:
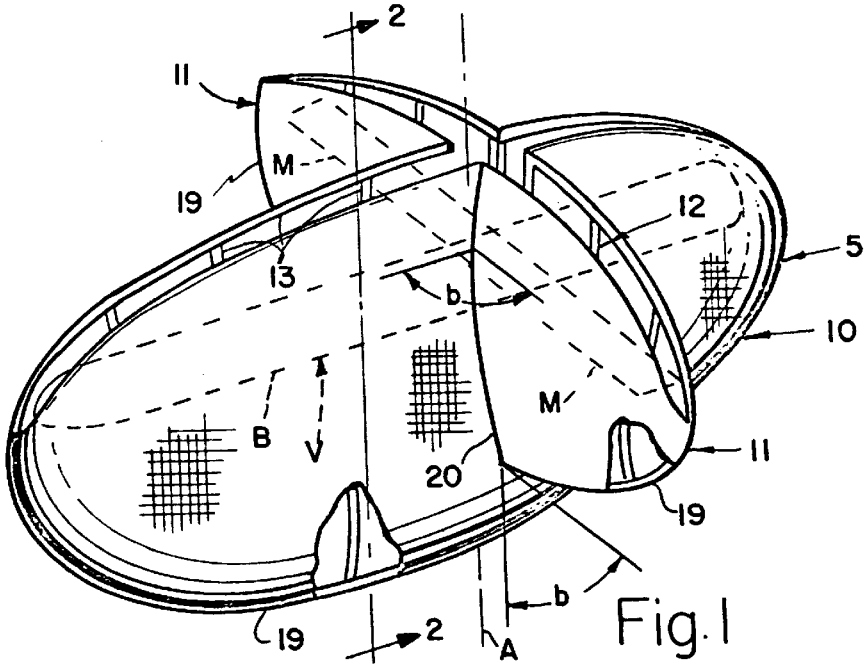
FIG. 1 is a perspective view, partly in section, of an antiradar screen structure according to the invention.

FIGS. 1 through 5 of the drawings illustrate a space vehicle V, in this instance an orbiting satellite vehicle, equipped with a crossed skirt antiradar screen structure S according to the invention. Vehicle V has a main body B mounting large deployable members M, referred to hereafter as cross arms, which project laterally from opposite sides of the body. These cross arms may be solar panels, linear antennae, or any of a variety of other devices which are commonly required on orbital satellite vehicles. During launch, the cross arms are retracted to stowed positions within the behicle body B. The arms are deployed to their extended positions in orbit.

The antiradar screen structure S includes a primary or body radar screen 10 enclosing the main vehicle body B and auxiliary or cross arm radar screens 11 enclosing the cross arms M. These radar screens are similar in construction to the radar screen of copending application Ser. No. 04/593,233. Thus, the screens have an inflatable frame 12 composed of thin-walled plastic tubes 13 which are arranged and joined in the manner shown with their passages in communication with one another and with a source (not shown) of inflation gas on the space vehicle V. Frame 12 is attached to the vehicle by plastic tubes or struts 14. Covering the frame are electrically conductive skirts 15 consisting of thin wire mesh whose grid dimensions are small with respect to the wavelength of search radar. To these radar wavelengths, the skirts behave as reflecting surfaces. The wire mesh 15 may be woven into or otherwise supported by a thin plastic membrane 16 secured to the frame tubes 13.

Figure 2:
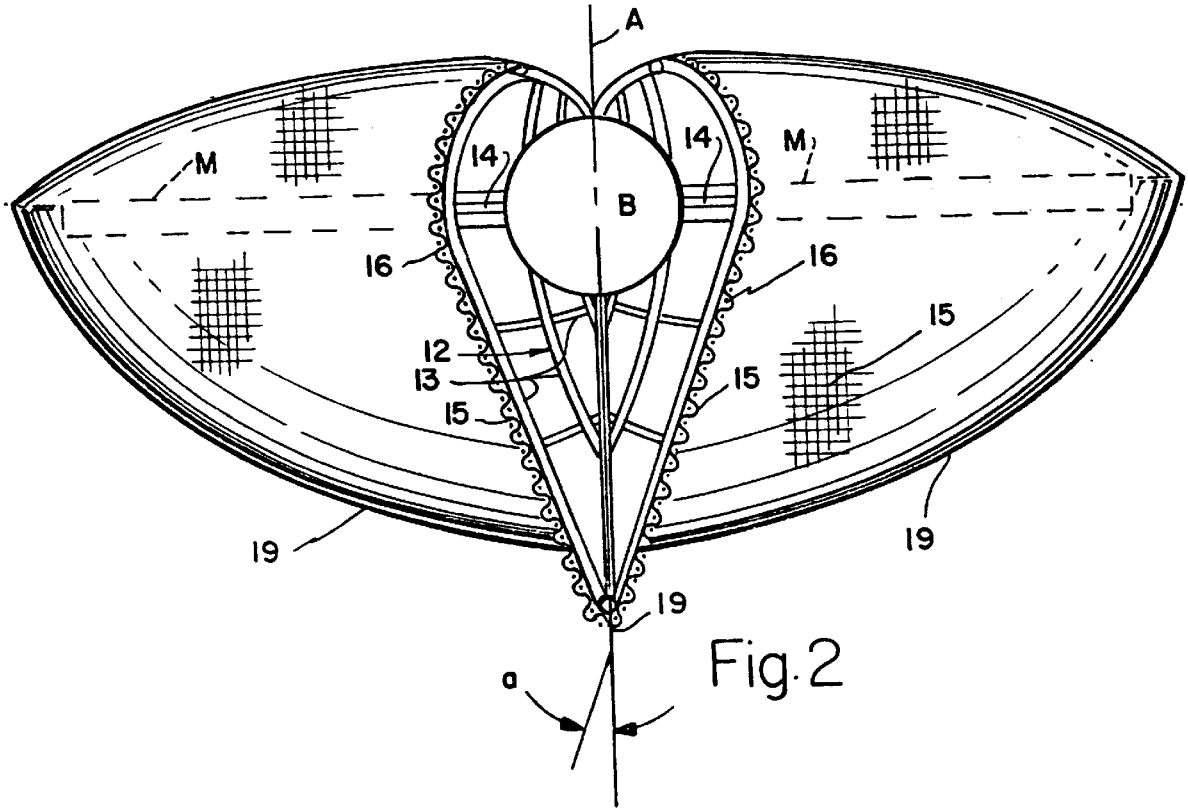
FIG. 2 is an enlarged section taken on line 2—2 in FIG. 1.
Figure 3:
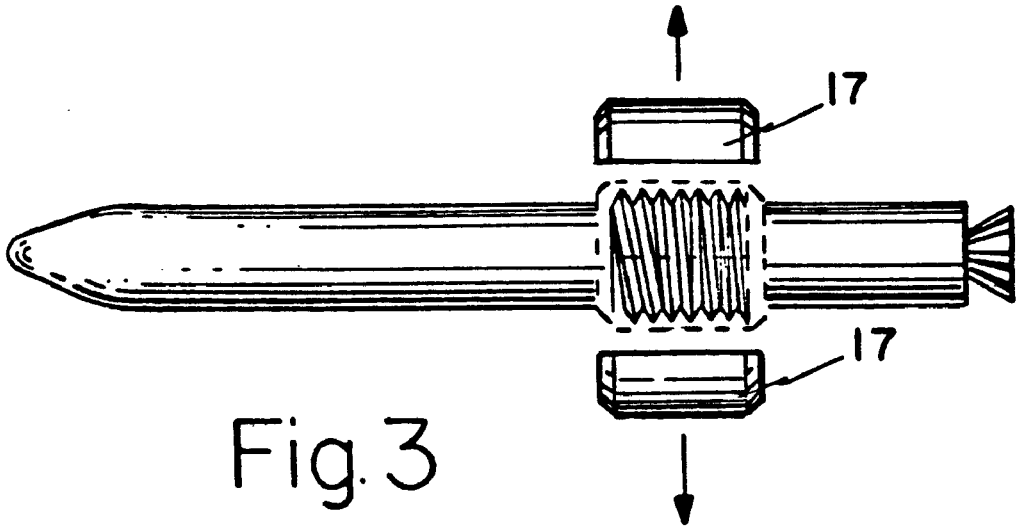
FIG. 3 illustrates the screen structure during deployment.

During launch the cross arms M are retracted to stowed positions within the space vehicle body B and the radar screen structure S is collapsed and gathered about or witin a stowage space in the body as shown in FIG. 3. The stowed screen is enclosed by covers 17 which are jettisoned in orbit. Gas under pressure is then fed to the frame tubes 13, 14 to inflate the same and thereby expand the screen structure to its fully deployed configuration of FIGS. 1 and 2. In this regard, it should be noted that the screen frame 12 is designed to assume, when inflated, the illustrated deployed configuration by appropriate shaping of the frame tubes and, if necessary, utilization of guy wires (not shown). Moreover, the plastic membrane 16 on the frame 12 is sized to stretch edgewise as the frame inflates to its final configuration. This stretching of the membrane stretches the thin wires of the conducting skirts 15 beyond their elastic limit, thereby permanently setting the skirts in their deployed configuration.

The membrane 16 may be constructed of a material which photolyzes in the vacuum environment of space under the radiation of the sun. It is also possible to have a preselected group of the frame tubes 13 photolyze leaving only those necessary for structural rigidity. A material which may be used for the subliming plastic is disclosed in "Material and Design Engineering", June 1966, page 32. The material is called "Photo-Lyzing Film" by the manufacturers, Goodyear Tire and Rubber Company. The wire mesh 16 could be replaced with a thin sheet of metal foil. The metal foil type skirt will have a greater weight than the wire mesh, however, and it will also increase the aerodynamic drag of the entire structure which may be undesirable in certain applications.

The shape of the antiradar screens 10, 11 is based on the lens-element theory of radar cross-section control and is designed to produce a constant magnitude signal at the search radar receiver. This theory relies on the electromagnetic reflection properties exhibited by a conducting biconvex lens. For such a lens illuminated edge-on, that is illuminated along the edge plane which is defined by the plane which passes through the edge (circumference) and the center of the lens, the maximum radar backscatter occurs when the polarization vector of the incident radiation lies in the lenses edge plane. This theory was disclosed in "A Theoretical Method for the Calculations of the Radar Cross Sections of Aircraft and Missiles", University of Michigan, Dept. of Elect. Eng., July 1959 by Crispin, J. W., et al. By convention, this orientation of the incident radiation in the lenses edge plane will be called parallel polarization and the resulting cross-section will be designated $\pi$. The orthogonal polarization will be designated $\pi$.

For small lens edge angles, $\pi$ can be computed from the return of a wire loop replacing the lens edge. For a wire radius-to-wavelength ratio =1/85, the edge-on maximum cross-section becomes $$\pi=\pi\rho^2[J_0(2\kappa\rho)-J_2(z\kappa\rho)]^2=4\ \pi\rho^2[J'_1(2\kappa\rho)]^2 \tag{1}$$

where $\lambda$=wavelength of incident radiation;

$\rho$=radius of wire loop;

$\kappa={}^2\pi/\lambda$;

$J_n$ is the bessel function of the nth order; and $J'z_n$ (x) is the derivative of $J_n$ with respect to x.

For other edge radii, wire thickness, equation (1) should be multipled by a corrective factor F given by $$F=\frac{(\pi/2)^2+[\ln(85/\gamma\pi)]^2}{(\pi/2)^2+[\ln(\lambda/\gamma\pi b)]^2} \tag{2}$$

where $\delta$=1.78 . . . and b is the equivalent wire radius. The wire radius-to-wavelength ratio of 1/85 was chosen to simplify equation (1). The envelope of equation (1) is computed to be $$\frac{2\rho\lambda}{\pi}.$$

Thus, one can write the following dominating expression for the maximum edge-on lens radar cross-section $$\Pi \leq \frac{2\rho\lambda F}{\pi} \tag{3}$$

If π is now compared with the detection threshold cross-section of a searching radar, then the simple lens-element theory which is defined by these makes two assumptions. One, that equation (3) with the equality sign applies to all points along the flight path of the satellite vehicle, and two, outside of the vehicle's flight path the equivalent lens is thin enough so that its cross-section still lies below the detection threshold of the searching radar.

Figure 4:
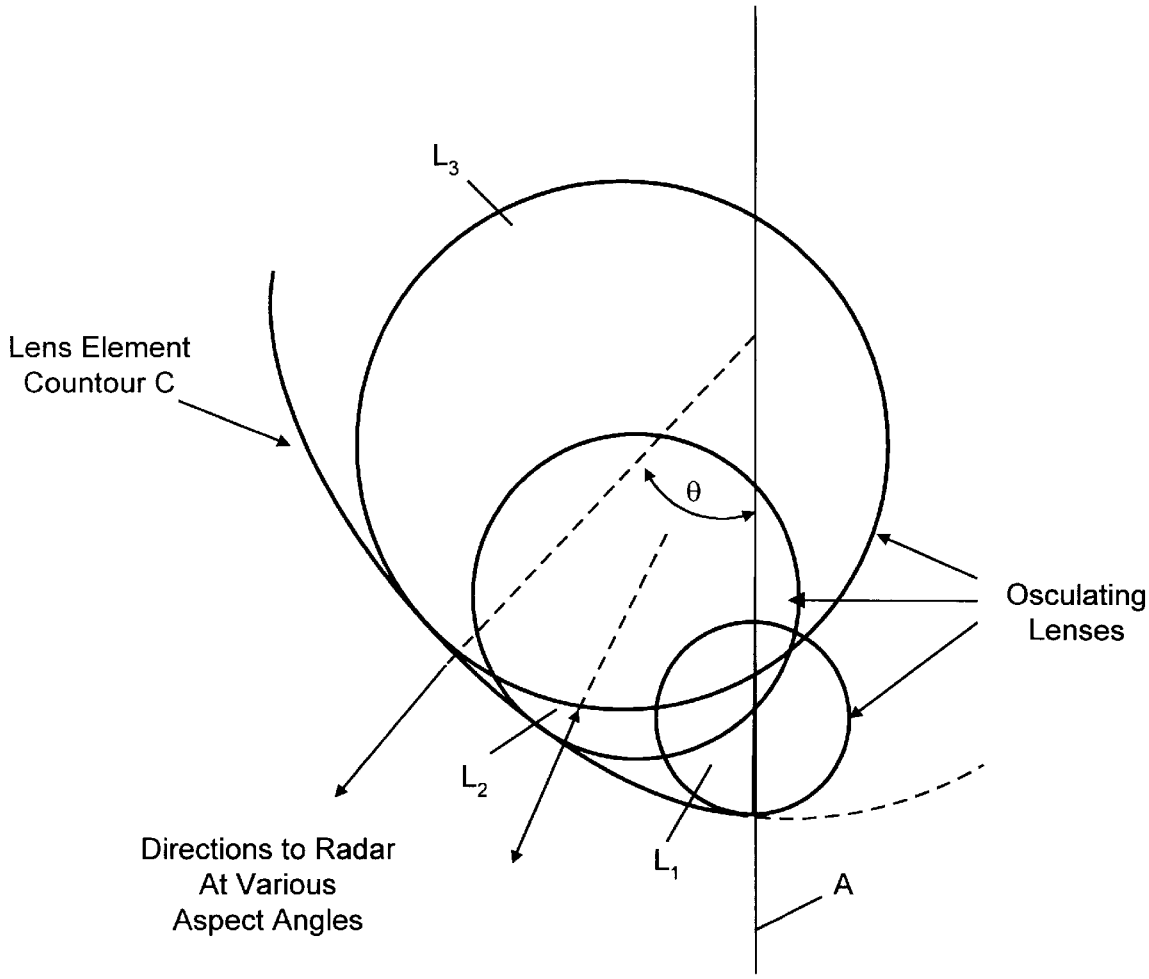
FIGS. 4 and 5 illustrate the biconvex lens theory upon which the radar screen is based.
Figure 5:
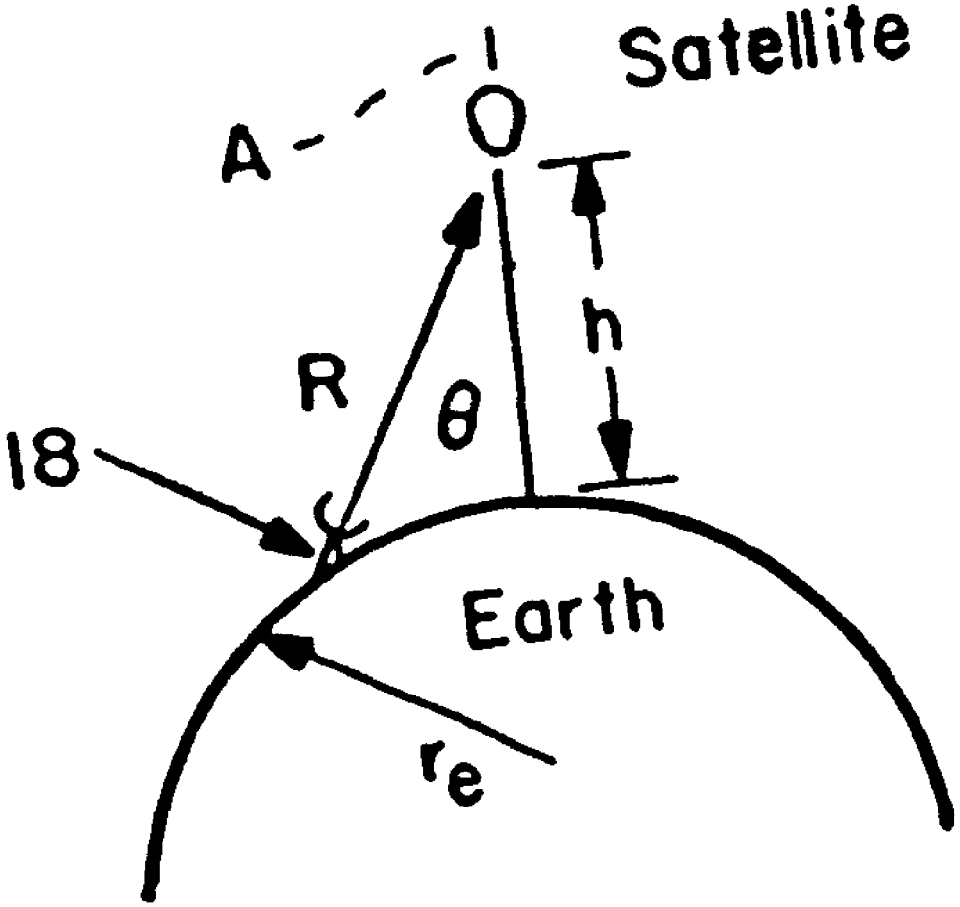

FIGS. 4 and 5 illustrate the application of this theory to the design of an antiradar screen for an orbiting satellite in the range of a detection radar 18. The vehicle orbits the earth in a fixed orientation relative to the earth wherein an axis A normal to the intersecting longitudinal axes of the body and cross arm skirts points toward the earth. The radar properties (illumination frequency), and the radar screen's orbit altitude H, and payload dimension are first selected. The radar distance R to the screen as a function of the aspect angle Θ from the verticle is calculated. The radar distance R is given by the expression $$R = (r_e + h)\cos\theta - \sqrt{r_e^2 - (r_e + h)^2\sin^2\theta} \tag{4}$$

where $r_e$ is the earth's radius and the screen's orbit direction lies in the plane of the drawing.

For each angle Θ, there is a unique R which increases with Θ. Correspondingly, for a particular Θ there is one unique biconvex lens, i.e., $L_1$, $L_2$, and $L_3$, whose radar cross-section viewed in its edge plane is just below the detection threshold of the given radar and whose properties viewed outside this plane are such that it also lies below the detection threshold of the given radar. Thus, for a given threat radar, the screen's design value of π is fixed for each value of R or Θ that is:

$$\Pi = \Pi\Big|_{\substack{\theta=o \\ R=h}} \times \left(\frac{R}{h}\right)^4 \tag{5}$$

Equations (2) through (5) define a lens-element contour C which determines an external contour for the keel edge 19 of each screen 10, 11. In other words, the keel edge contour is defined by a series of overlapping, or in mathematical terms "osculating", lenses, which are appropriately terminated in the electromagnetic shadow zone resulting in the simple conducting lens-element shape shown. This edge contour varies from angle to angle in the plane of the screen's direction of motion increasing in radius with Θ. A comprehensive disclosure of this biconvex lens theory as applied to a vehicle radar screen is contained in applicant's copending application Ser. No. 721,513, filed Apr. 8, 1968 entitled "Radar Screen (U)".

Referring to FIGS. 1 and 2, the screen keel edges 19 have a variable sharpness or edge angle a to further refine the biconvex lens edge effect. Thus, it will be observed that the edge angle a increases toward the outer ends of the keel edges. If this edge sharpness is not varied there will be a degradation in the screen effect. FIG. 2 illustrates a portion of the body screen keel where the edge is very sharp.

There are six independently adjustable design parameters of each skirt 15. The first two, edge sharpness and radius of curvature of the keel, control the skirt's signature in its edge plane. The next two parameters, edge angle and the curvature of the skirt surfaces, control the signature in a plane normal to the skirt's edge. The last two, leakage and warp and woof sizes (size and shape of skirt screen mesh), control the polarization characteristics of the signature.

In summary, the antiradar screen structure S of this invention is erected around the space vehicle V to simplify its radar signature so that decoys may be used in combination with the screened vehicle to confuse, delay, and/or eliminate final detection. Upon illumination by a ground based search radar, the antiradar screen structure re-radiates only a small amount of energy in the backscattering direction. Both the reflected incident energy and the energy radiated from the screen structure by currents induced in the conducting skirts 15 are exceedingly small in the backscattering direction.

In the particular inventive embodiment illustrated in FIGS. 1 through 5, the conductive skirts 15 of the screens 10, 11 are physically and electrically joined along corner edges 20. Thus, the skirts effectively constitute a single unitary skirt which encloses and thereby controls and reduces the radar cross-section of the entire satellite vehicle V. The screens thus form a number of interior corners. According to a feature of the invention, the radar skirts are shaped and arranged in a manner such that each interior corner has an oblique angle b of sufficient magnitude to avoid a corner reflector effect which would produce retroreflection of an illuminating radar beam from a ground radar detection site back to the site. According to the preferred practice of the invention, for example, each interior corner has an angle b equal to or greater than 100°.

Figure 6:
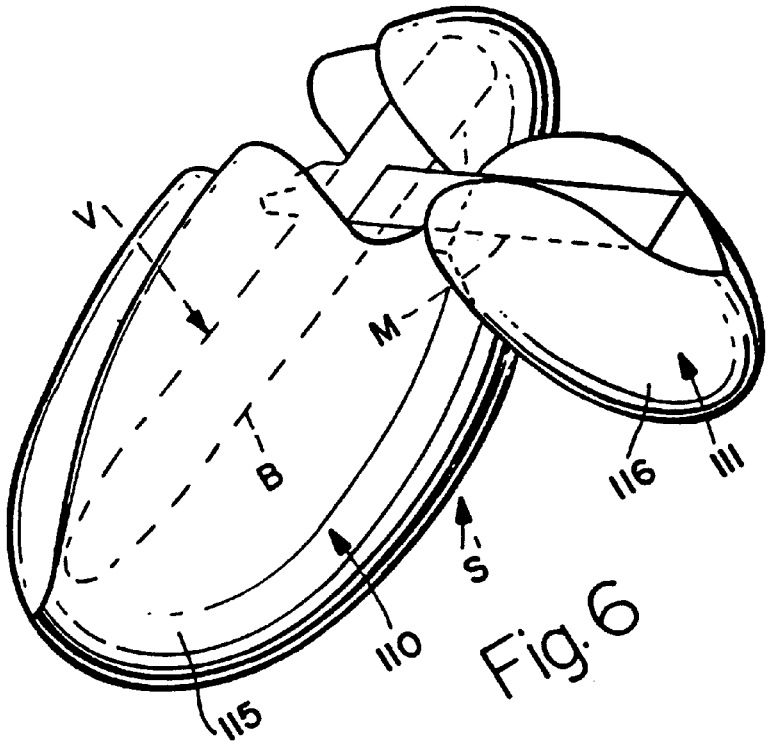
FIG. 6 is a perspective view of a modified antiradar screen structure according to the invention.
Figure 7:
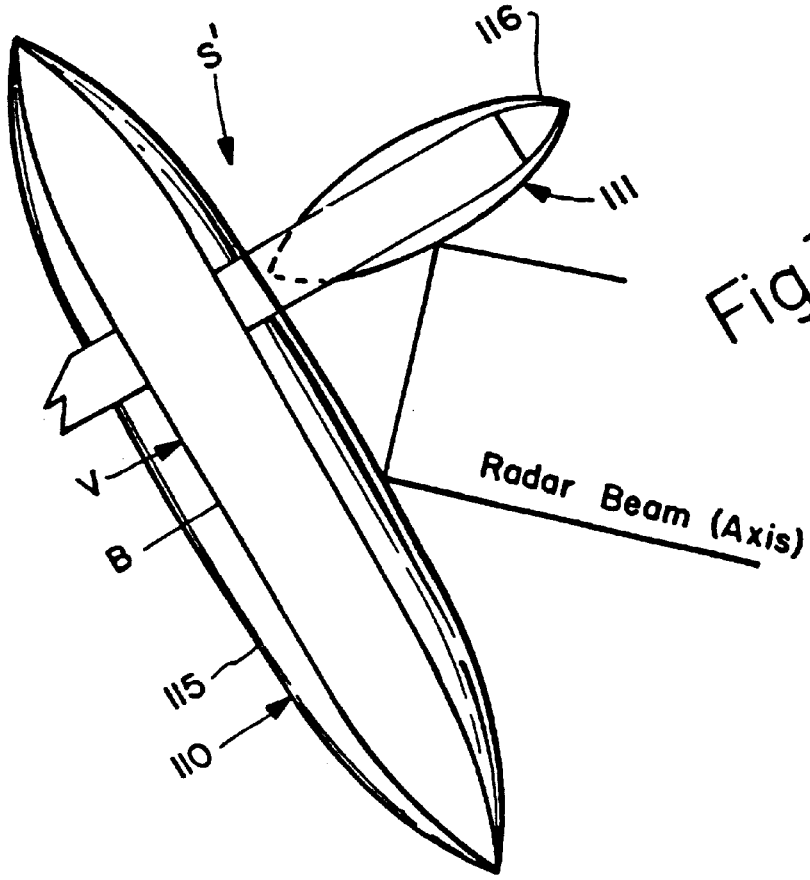
FIG. 7 is a plan view of the modified screen structure on reduced scale.

FIGS. 6 and 7 illustrate a modified antiradar screen structure S' according to the invention having a main body screen 110 for the body B of the satellite vehicle V and auxiliary or cross arm screens 111 for the vehicle cross arms M. The body screen 110 has essentially the same shape and construction as the body screen 10 in FIGS. 1 through 5 and includes an electrically conductive body skirt 115 of essentially the same biconvex lens configuration as the body skirt 15 in FIGS. 1 through 5. The body skirt 115 is supported on an inflatable flexible tubular frame (not shown) which is attached to the vehicle body B and is inflatable to expand the screen 10 to its illustrated deployed configuration in essentially the same manner as the screen in FIGS. 1 through 5.

The cross arm screens 111 have electrically conductive skirts 116 of essentially the same biconvex lens configuration as the body skirt 115. The physical dimensions of the cross arm skirts, however, are smaller than those of the body skirt owing to the relatively small size of the cross arms M compared to the vehicle body B. Skirts 116 are mounted on inflatable flexible tubular frames (not shown) which are attached to the cross arms M and are inflatable to expand the skirts to their deployed configurations illustrated, after deployment of the arms to their illustrated extended positions, in much the same manner as the body skirt. A major difference between the radar screen structure S' of FIGS. 6 and 7 and the earlier screen structure S' of FIGS. 1 through 5, resides in the fact that the inner ends of the cross arm skirts 116 terminate in spaced relations to the body skirt 115. Accordingly, the body and cross arm skirts are both physically and electrically isolated from one another.

In this particular embodiment of the invention, it is necessary to make each skirt of the radar structure S' as thin as possible to increase the angular region over which the skirt is effective to control the radar cross-section of its respective member, i.e., either the vehicle body B or cross arms 11. The cross arm skirts then exercise signature control over a wide angle beneath the satellite vehicle B. In operational use of the screen structure S', illumination of an exposed portion of the cross arms M in the region between the body skirt 115 and a cross arm skirt 116 produces a main lobe of reflected radar energy which is broken up by the skirts and thereby converted to an erratic signature. The erratic radar signature may be readily simulated by a pin-cushion decoy of the type disclosed in copending application Ser. No. 591,395 by providing the decoy with selected microwave reflectors or dipoles of the proper resonant frequency.

It will be observed in FIG. 7 that the corner reflection effect may occur in the event of radar illumination of the screen structure S' within a very narrow range to either side of normal incidence, i.e., illumination of the screens by a radar beam arriving substantially in a plane normal to the skirt surfaces. However, it is evident that illumination of the screen structure by ground based detection radar will always occur within a range of incidence angles substantially less than normal incidence. Within this latter range, the interior corners defined by the body and cross arm skirts 115 and 116 will always present to the illuminating radar effective interior corner angles in the plane of the illuminating radar beam which are sufficiently large, i.e., equal to or greater than 100°, to avoid the corner reflector effect and thereby prevent retroreflection of radar energy.

What is claimed as new in support of Letters Patent is:

1. An antiradar screen for a space vehicle having a main body and a cross arm projecting laterally from said body comprising:

a body screen including a hollow electrically conductive skirt constructed of an electrically conductive screen mesh for at least partially enclosing said vehicle body; and a cross arm screen including a hollow electrically conductive skirt constructed of an electrically conductive screen mesh and projecting laterally of said body skirt for at least partially enclosing said vehicle cross arm.

2. A radar screen according to claim 1 wherein:

the inner end of the cross arm skirt is physically and electrically joined to said body skirt.

3. A radar screen according to claim 2 wherein:

said skirts define a number of interior corners; and the interior angle of each said corner is substantially greater than 90°.

4. A radar screen according to claim 1 wherein:

the inner end of said cross arm skirt terminates in spaced relation to said body skirt; and said skirts are arranged to break up the main lobe of radar energy reflected from said cross arm between said skirts.

5. A radar screen according to claim 4 wherein:

said skirts define a number of interior corners; and the interior angle of each said corner being at least substantially equal to 100° in planes other than a plane normal to said body and cross arm skirts.

6. A radar screen according to claim 1 wherein:

said vehicle is launched into orbit about the earth in a fixed attitude wherein an axis of said radar screen points toward the earth; and each said skirt has a keel edge transverse to said axis whose contour is defined by a plurality of biconvex lens-elements arranged adjacent to one another along said edge and increasing in radii outwardly along said edge away from said axis according to a function of the aspect angle which the skirt presents to a radar on the earth, said lens-elements being joined to form a single osculating structure.

* * * * *